United States Patent [19]

Lilos

[11] Patent Number: 4,980,808

[45] Date of Patent: Dec. 25, 1990

[54] LIGHTING FIXTURE

[76] Inventor: Nicholaos Lilos, 1-3 Patriarchou Fotiou St., K. Pefki, Athens, Greece

[21] Appl. No.: 431,460

[22] Filed: Nov. 3, 1989

[51] Int. Cl.[5] ..... F21S 3/02

[52] U.S. Cl. ..... 362/219; 362/225; 362/404

[58] Field of Search ..... 362/217, 219, 221, 225, 362/404, 147, 260

[56] References Cited

U.S. PATENT DOCUMENTS

| | | | |
|---|---|---|---|
| 2,288,941 | 7/1942 | Curtis | 362/375 |
| 2,291,480 | 7/1942 | Naysmith | 362/221 |
| 2,368,810 | 2/1945 | Donnelly | 362/346 |
| 3,377,488 | 4/1968 | Lorenzo | 362/217 |
| 3,428,799 | 2/1969 | Bassani | 362/219 |
| 4,726,781 | 2/1988 | Bernhart et al. | 362/219 |

*Primary Examiner*—Ira S. Lazarus
*Assistant Examiner*—Richard R. Cole
*Attorney, Agent, or Firm*—John M. Brandt

[57] ABSTRACT

A combination lighting fixture and wiring conduit for fluorescent tubes arranged to both support such tubes and provide isolated channels for other wiring needs. The fixtures are intended to be mounted in multiples in end to end relationship and consist of a plurality of sheet components which fit together in interlocking relationship.

3 Claims, 2 Drawing Sheets

LIGHTING FIXTURE

BACKGROUND OF THE INVENTION

1. Field of the Invention:

The invention resides in the field of lighting fixtures and more particularly relates to elongated fluorescent type structures.

2. Description of the Prior Art:

A number of novel devices for supporting fluorescent type light tubes exist in the prior art. Among these are U.S. Pat. Nos. 1,949,709, Coy; 2,288,941, Curtis; 2,291,490 and 2,291,491, Naysmith; and 2,682,644, D'Esopo.

None of these nor any other devices known to the inventor disclose the combination of the improved features which constitute the device described herein. Specifically, the fixture which is the subject of the application is adapted to function both as a support for the components of a fluorescent lighting system and to act as a conduit consisting of a plurality of isolated channels for the routing of cables within an installation. The structure disclosed herein provides for a continuous linking of a number of such fixtures as is required by building layout through the use of appropriate tees, elbows, crosses and bends and thus allows auxiliary electrical devices requiring cable connections to be located anywhere within the system without the need for alternative wiring paths. For example, the isolated channels may carry power cables for the lamps themselves, power cables for low voltage security lighting, telephone cables, computer cables, cables for fire detectors, and any other devices which might be located in a modern office or industrial plant.

The purposes of the invention are realized by the provisions of a unique mechanical structure consisting of relatively few interlocking sheet components which are easily assembled on site and thus may be transported in quantities of like units resulting in a substantial savings in space and cost to the user.

SUMMARY OF THE INVENTION

In accordance with the objects of the invention, the lighting fixture consists of a top cover, and a bottom cover arranged to snap together by appropriately placed tongue and groove indentations, fixture to fixture connectors of a configuration to provide an overlapping or mating to fit in conjunction with the top and bottom covers; two opposed upright channel forming members attached to the bottom cover; a cross member arranged to span the two upright channel members to form a central channel; and fixture supports in the form of, for example, a threaded rod attached to the cross member. A reflector extends from the bottom cover to complete the assembly.

As will be more clearly understood from the drawings and description of the preferred embodiment which follow, the invention provides a relatively simplified and inexpensive lighting fixture which uses standardized, interchangeable parts to form a structure providing both an easily assembled multichannel wiring conduit and a support for a fluorescent lighting system.

DESCRIPTION OF THE PREFERRED EMBODIMENT

Figure 1:
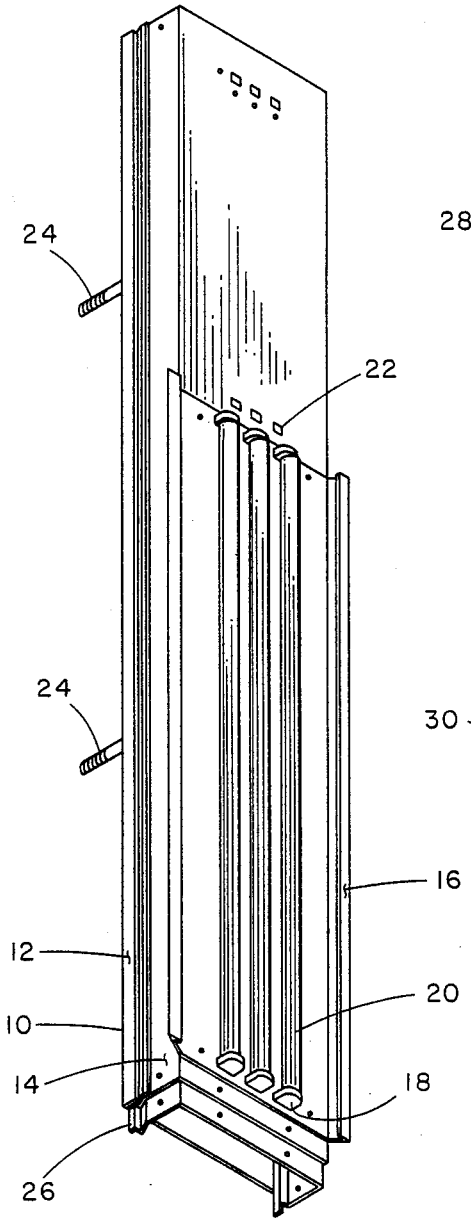
FIG. 1 is a perspective view of the preferred embodiment of the invention.

Referring first to FIG. 1, a perspective view of the preferred embodiment is shown from below in which fixture 10 consists of top cover 12, bottom cover 14 and reflector 16 attached to cover 14 by screws or other appropriate means. Fluorescent tube sockets 18 extend through reflector 16 and are similarly attached to cover 14 by screws or spot welds. Tubes 20 fit between the sockets and more than one bank may be included in each fixture as is indicated by holes 22 in cover 14 for receiving sockets 18.

The fixture is mounted by one or more rods 24 which extend from inside the covers as will be shown below. A connector 26 for joining one fixture to another is screwed or welded at one end and fits inside cover 14.

Figure 2:
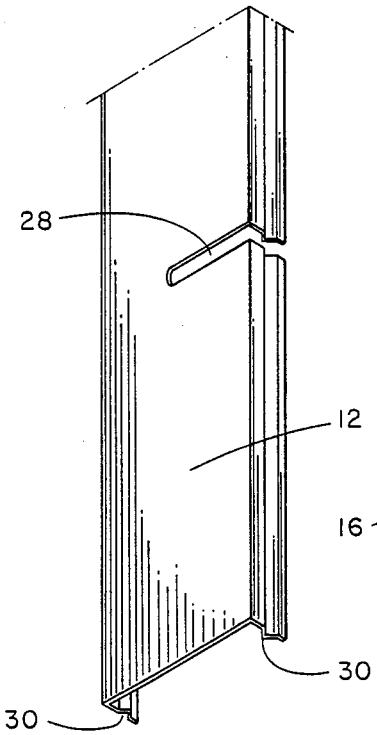
FIG. 2 is a perspective view of one component of the embodiment of FIG. 1.
Figure 3:
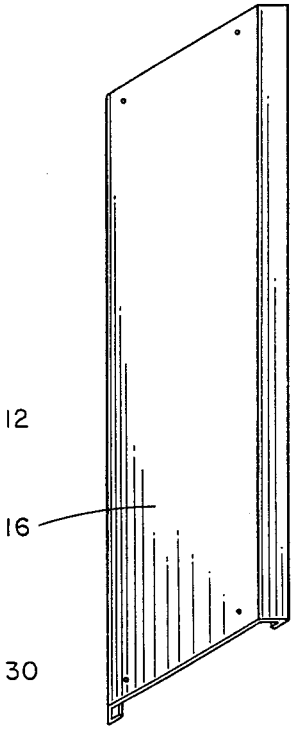
FIG. 3 is a perspective view of another component of FIG. 1.
Figure 4:
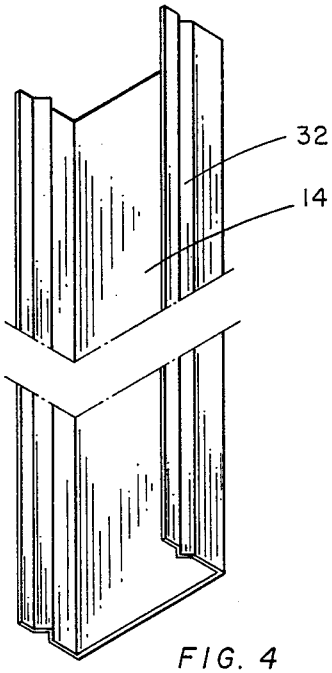
FIG. 4 is a perspective view of another component of FIG. 1.

Referring next to FIG. 2, cover 12 is shown in perspective view from the top and has slot 28 for receiving mounting rod 24. The side portions of cover 12 are indented to form a tongue 30 for mating with bottom cover 14 as is illustrated in FIG. 3. The side portion of bottom cover 14 is similarly indented to form a groove 32 for receiving tongue 30. FIG. 4 is a perspective view from the top of reflector 16.

Figure 5:
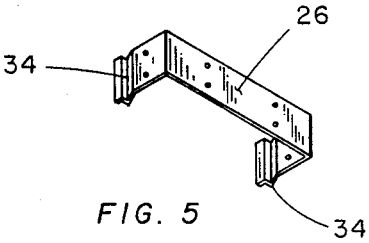
FIG. 5 is a perspective view of another component of FIG. 1.

FIG. 5 illustrates connector 26 in perspective view. The side portions are indented to form a groove 34 which when the fixture is assembled, will receive the tongue 36 on cover 14 formed by the reverse of groove 32.

Figure 6:
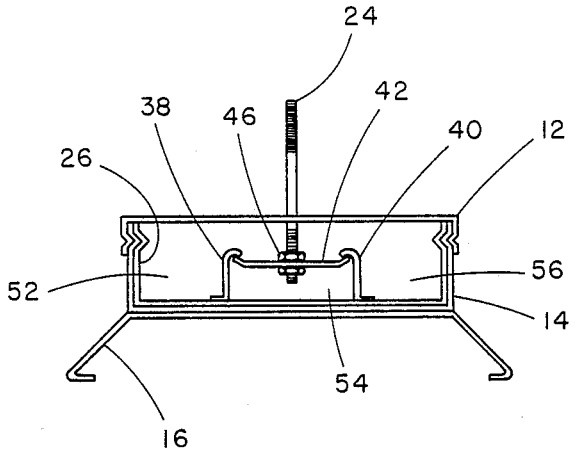
FIG. 6 is a cross sectional view of the embodiment of FIG. 1.
Figure 7:
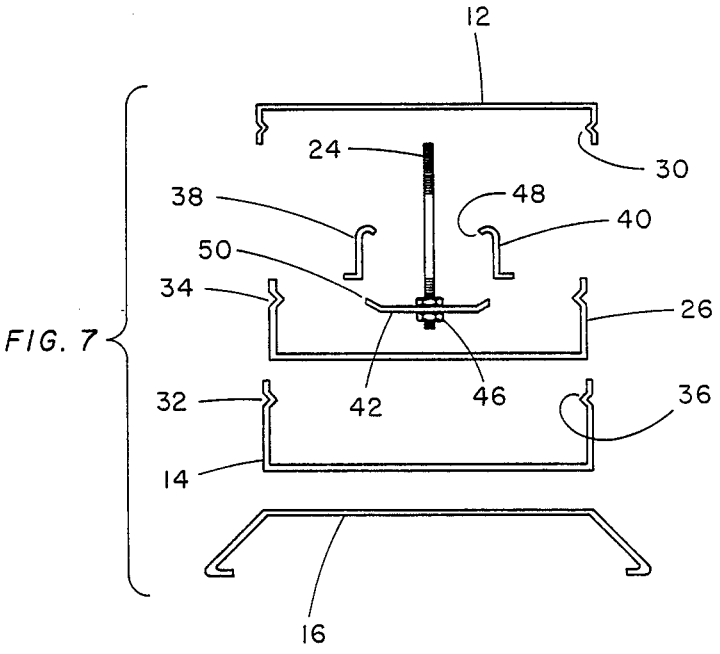
FIG. 7 is an exploded cross sectional view of FIG. 6.

Thus as will be more clearly seen from FIG. 6 and FIG. 7, covers 12 and 14 snap together, cover 12 over cover 14, and connector 26 similarly snaps inside bottom cover 14, all in the same tongue and groove location.

Referring further to FIGS. 6 and 7, a pair of opposed or spaced apart upright channel forming members 38 and 40 divide the interior of the fixture into three separate compartments suitable for carrying wires or cables of the same or different voltages for a variety of purposes as mentioned above.

Members 38 and 40 serve an additional function of providing support for cross member 42 which may extend completely along or span only a shorter portion of the upright members.

Figure 8:
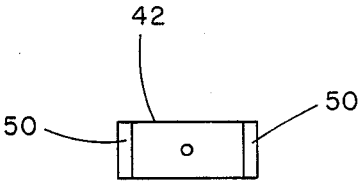
FIG. 8 is a plan view of a component of FIG. 6.

Attached to cross member 42 is fixture support rod 44 which may be threaded and held in position by nuts 46. Although other means may be used to secure cross member 42 to upright members 38 and 40, in the embodiment shown each upright is provided with a lip 48 and each edge of the cross member with an upturned portion 50. The lip and upturned portion interlock from the weight of the fixture when supported from the rod allowing the fixtures to be easily mounted or removed as is required. In addition, the cross member and support rod assembly provide further isolation of the three wiring compartments designated 52, 54, and 56 in FIG. 6. FIG. 8 further illustrates cross member 42 in plan view.

The fixture described herein may be assembled in any combination of patterns which are required for a particular location by using interconnecting ducts in the form of, for example, bends, tees and cross members, not shown, which fit over the extending portion of connectors 26. Appropriate ports and receptacles, also not shown, may be included in the sides, top or bottom of each fixture for access to the various wires and cables which are intended to be carried by the interior channels of the fixture.

As will now be apparent, these and other variations and additions may be incorporated into the above described combination lighting fixture and wiring conduit without departing from the scope of the invention which is accordingly defined by the following claims.

What is claimed is:

1. A combination wiring conduit and lighting fixture arranged to support a fluorescent lighting system comprising:

a. a top cover comprised of a horizontal sheet and two downwardly extending side sheets;

b. a bottom cover comprised of a horizontal sheet and two upwardly extending side sheets, said side sheets of both of said covers having mutually interlocking tongue and groove formations extending the length of said sheets;

c. a reflector attached to said bottom cover comprised of a horizontal sheet and two outwardly extending side sheets;

d. a connector arranged to join two of said fixtures, comprising a horizontal sheet and two upwardly extending side sheets each having tongue and groove formations adapted to mutually interlock with at least one of said covers;

e. a pair of spaced apart upright channel forming members attached to said bottom cover arranged to divide the interior of said fixture into isolated wiring channels;

f. a cross member positioned between and attachable to said channel forming members; and g. support means for attaching said fixture to an overhead structure.

2. The apparatus of claim 1 wherein said support comprises a threaded rod attached to said cross member.

3. The apparatus of claim 2 wherein the upper edge of each channel forming member is formed into an interiorly directed lip, said cross member has upturned edges and said lip and said edges interlock to support said fixture when hung from said overhead structure.

* * * * *